US007673817B2

(12) United States Patent
Brauneis et al.

(10) Patent No.: US 7,673,817 B2
(45) Date of Patent: Mar. 9, 2010

(54) FUEL INJECTOR COMPRISING A FILTER UNIT

(75) Inventors: Roman Brauneis, Bonn (DE); Dejan Jovovic, Regensburg (DE); Maximilian Kronberger, Steyr (AT)

(73) Assignee: Continental Automotive GmbH, Hannover (DE)

( * ) Notice: Subject to any disclaimer, the term of this patent is extended or adjusted under 35 U.S.C. 154(b) by 196 days.

(21) Appl. No.: 11/816,724

(22) PCT Filed: Feb. 24, 2006

(86) PCT No.: PCT/EP2006/001705

§ 371 (c)(1),
(2), (4) Date: Aug. 30, 2007

(87) PCT Pub. No.: WO2006/089765

PCT Pub. Date: Aug. 31, 2006

(65) Prior Publication Data

US 2008/0164348 A1 Jul. 10, 2008

(30) Foreign Application Priority Data

Feb. 25, 2005 (DE) ..... 10 2005 008 697

(51) Int. Cl.
*B05B 1/30* (2006.01)
*F02M 61/20* (2006.01)

(52) U.S. Cl. ..... 239/575; 239/88; 239/533.3; 239/533.9; 239/584; 239/600; 239/124; 123/470

(58) Field of Classification Search ..... 239/88, 239/533.3, 533.8, 533.9, 533.12, 584, 585.1, 239/575, 600, 124, DIG. 23; 123/470
See application file for complete search history.

(56) References Cited

U.S. PATENT DOCUMENTS

| | | | | |
|---|---|---|---|---|
| 3,587,977 | A | 6/1971 | Fussner et al. | 239/533 |
| 3,820,213 | A | 6/1974 | Kent | 29/156.7 R |
| 4,453,671 | A * | 6/1984 | Hafner | 239/124 |
| 4,527,737 | A * | 7/1985 | Deckard | 239/124 |
| 4,618,095 | A | 10/1986 | Spoolstra | |
| 5,088,650 | A | 2/1992 | Takagi et al. | 239/275 |
| 5,238,192 | A * | 8/1993 | McNair | 239/575 |
| 5,402,944 | A | 4/1995 | Pape et al. | 239/88 |

(Continued)

FOREIGN PATENT DOCUMENTS

DE 1806674 5/1970

(Continued)

OTHER PUBLICATIONS

Search Report and Written Opinion for Application No. PCT/EP2006/001705 (14 pages), May 30, 2006.

*Primary Examiner*—Steven J Ganey
(74) *Attorney, Agent, or Firm*—King & Spalding L.L.P.

(57) ABSTRACT

A fuel injector (1), in particular a pump-nozzle injector for a diesel engine has an injector body (50), which is held in place with a nozzle body (40) and/or a lower body (60) by a clamping nut (10, 30). The fuel supply conduit of the injector body (50) is provided with a fuel filter (20), which is offset in the longitudinal direction of the fuel injector (1) in relation to the clamping nut (10, 30) and is configured independently of said clamping nut (10, 30) on the fuel injector (1).

18 Claims, 2 Drawing Sheets

U.S. PATENT DOCUMENTS

| | | | | |
|---|---|---|---|---|
| 5,516,047 | A | 5/1996 | Kubach et al. | 239/585.5 |
| 6,283,390 | B1 | 9/2001 | Brendle et al. | 239/533.2 |

FOREIGN PATENT DOCUMENTS

| | | |
|---|---|---|
| DE | 3811002 | 10/1989 |
| DE | 4000044 | 7/1991 |
| DE | 4328418 | 3/1995 |
| DE | 19752834 | 6/1999 |

* cited by examiner

Detail Y

FUEL INJECTOR COMPRISING A FILTER UNIT

CROSS-REFERENCE TO RELATED APPLICATIONS

This application is a U.S. national stage application of International Application No. PCT/EP2006/001705 filed Feb. 24, 2006, which designates the United States of America, and claims priority to German application number 10 2005 008 697.7 filed Feb. 25, 2005, the contents of which are hereby incorporated by reference in their entirety.

TECHNICAL FIELD

The invention relates to a fuel injector, in particular a pump-nozzle injector, for diesel engines that has a filter device for filtering the fuel requiring to be injected by the fuel injector in order especially to protect the injection openings of the fuel injector from clogging.

BACKGROUND

Fuel injectors have a nozzle body and an injector body that are combined axially into a structural unit by means of a clamping sleeve. Depending on the specific design of the fuel injector, the injector body can be subdivided further. In the case of a pump-nozzle injector, for instance, the injector body is divided into a spring body or spring retainer and a pump body having a typically laterally projecting control valve. The spring body and pump body are likewise clamped together by the clamping sleeve. Other fuel injectors having a multi-part or single-part injector body can be found in the prior art, with the clamping sleeve clamping together the main constituents of the fuel injector. The fuel injector can be inserted into an internal combustion engine's housing, usually a cylinder head, and supplies the combustion chambers of the internal combustion engine with fuel.

Inside the fuel injector, the fuel conveyed by the fuel injector (pump-nozzle concept) or the fuel conveyed under high pressure through the fuel injector (common-rail concept) reaches the nozzle body via lines and, when a valve-needle opening pressure has been exceeded, is injected from said body into the combustion chamber of the internal combustion engine via nozzle openings.

Because the fuel can never be completely free from particulate impurities due to, for instance, burrs and dust in the cylinder head, and in order hence to protect the very small nozzle openings in the nozzle body from clogging and to prevent consequent changes in the volume of injected fuel as well as imprecise injection jet characteristics, it is necessary to filter the fuel requiring to be injected by the fuel injector and thereby eliminate or reduce the risk of clogging.

Provided therein in the prior art in the area of an annular fuel-inlet conduit to the fuel injector in a nozzle clamping nut are relatively large bores leading to a supply line that extends to the control valve inside the fuel injector. The bores in the nozzle clamping nut are therein evenly disposed around its circumference, with an annular filter set in the nozzle clamping nut having being applied in the circumferential direction around the bores.

DE 197 52 834 A1 further discloses a nozzle clamping nut that implements a filter function without an additionally applied annular filter. Provided in an inlet area on the nozzle clamping nut are a multiplicity of filter bores therein disposed evenly around the nozzle clamping nut's circumference in a plurality of rows. The diameter of the filter bores is preferably 30 to 90 μm and the filter bores are by preference embodied conically. In the case of a preferred production method using a pulsed electron or laser beam the result is further a helical row of filter bores in the circumferential direction in the circumferential wall of the nozzle clamping nut.

Because a clamping sleeve on a fuel injector is exposed to high thermal (−40° C. to 150° C.) and high mechanical loads (vibration loading due to a piezoelectric stack operating in the fuel injector), said sleeve should as far as possible have no preset breaking points so that a clamping sleeve of said kind will have an insured durability. A clamping sleeve having a circumferential wall embodied in the circumferential direction without interruptions can furthermore be constructed having a narrower width but the same strength, which requires less space inside a cylinder head. A clamping sleeve having an integral filter function furthermore poses the problem that the clamping sleeve and filter have been produced from the same material. That on the one hand necessitates a compromise in how the clamping sleeve or, as the case may be, filter is worked because the clamping sleeve is subject to different requirements in being worked from those applying to the filter provided therein. On the other hand a compromise has to be found in the choice of suitable materials as they are subject to different requirements: the filter must provide as efficient as possible a filtering function, whereas the clamping sleeve must provide an as durable and as strong as possible connection between the main components of the fuel injector. The main focus here is on the integrity of the fuel injector, meaning that compromises usually have to be made with the filter.

SUMMARY

An improved fuel injector that will in particular be lastingly durable and lastingly functional can be provided. Also, a simple and economical fuel filter for a fuel injector, in particular for a pump-nozzle injector, without adversely affecting the functioning capability of a clamping sleeve, in particular a nozzle clamping nut can be provided.

According to an embodiment, a fuel injector, may comprise an injector body being clamped by means of a clamping nut to a nozzle body and/or lower body, and a fuel filter provided on a fuel-inlet conduit of the injector body, wherein the fuel filter is with reference to a longitudinal direction of the fuel injector arranged offset relative to a clamping nut and is embodied independently of the clamping nut on the fuel injector.

According to a further embodiment, a nozzle clamping nut may externally clamp the nozzle body to the injector body and the fuel filter on the injector body, adjoining the nozzle clamping nut in the longitudinal direction of the fuel injector, may be provided externally. According to a further embodiment, a lower clamping nut externally clamps the lower body to the injector body and a fuel-return conduit connector, serving as a fluid conduit for a fuel-return conduit, on the injector body can be applied externally adjacent to the lower clamping nut in the longitudinal direction of the fuel injector. According to a further embodiment, —apart from sealing devices— on the injector body, the nozzle clamping nut may adjoin the fuel filter, which may adjoin the fuel-return conduit connector, which may adjoin the lower clamping nut sequentially in the longitudinal direction. According to a further embodiment, provided on the injector body between the fuel filter and fuel-return conduit connector may be a sealing washer and, directly adjacent to the lower clamping nut, a sealing washer that is arranged preferably between the lower clamping nut and fuel-return conduit connector, with the sealing rings sealing the fuel injector section by section from a cylinder head. According to a further embodiment, the fuel-inlet conduit can be embodied as an annular chamber substantially completely encircling the injector body, which chamber is adjoined radially outward by the fuel filter embodied as a single annular sleeve. According to a further embodiment, the fuel-inlet conduit embodied as an annular chamber may be formed preferably by means of an annular recess in the injector body or by means of an annular recess in the fuel filter. According to a further embodiment, the fuel-return conduit may be embodied as an annular chamber substantially completely encircling the injector body, which chamber is adjoined radially outward by the fuel-return conduit connector embodied as a single annular sleeve. According to a further embodiment, the fuel-return conduit embodied as an annular chamber may be formed by means of an annular recess in the injector body or, preferably, by means of an annular recess in the fuel-return conduit connector. According to a further embodiment, provided for filtering in a circumferential wall of the fuel filter may be a multiplicity of substantially radially arranged filter bores that are arranged in the circumferential direction of the circumferential wall preferably in an encircling spiral and which may have three to eight, preferably four to seven, in particular five to six, and in particular preferably approximately 5.2 revolutions in the circumferential direction of the fuel filter. According to a further embodiment, the fuel filter may have 80 to 200, preferably 100 to 180, in particular 120 to 160, and in particular preferably 144 filter bores in each turn of the spiral. According to a further embodiment, a gap width or, as the case may be, a diameter of a filter bore of the fuel filter may be 20 to 90 μm, preferably 30 to 80 μm, in particular 40 to 75 μm, in particular preferably 50 to 70 μm. According to a further embodiment, a cross-sectional profile of the circumferential wall of the sleeve-shaped fuel filter may be substantially L-shaped, with the free end of the longer spine of the L being preferably seated on the lower nozzle clamping nut. According to a further embodiment, the filter bores can be produced by means of an electron or laser beam, with the relevant energy beam being operated in a pulsed manner and one filter bore being produced with each pulse.

According to yet a further embodiment, a cylinder head or diesel engine may have such a fuel injector. According to a further embodiment, According to a further embodiment, two mutually separate, annular fuel-ducting areas can be provided by means of sealing surfaces embodied on the cylinder head and of the arrangement of the sealing rings on the fuel injector between the cylinder head and fuel injector.

BRIEF DESCRIPTION OF THE DRAWINGS

The invention will be explained in more detail below with the aid of exemplary embodiments and with reference to the attached drawing, in which.

DETAILED DESCRIPTION

Figure 1:
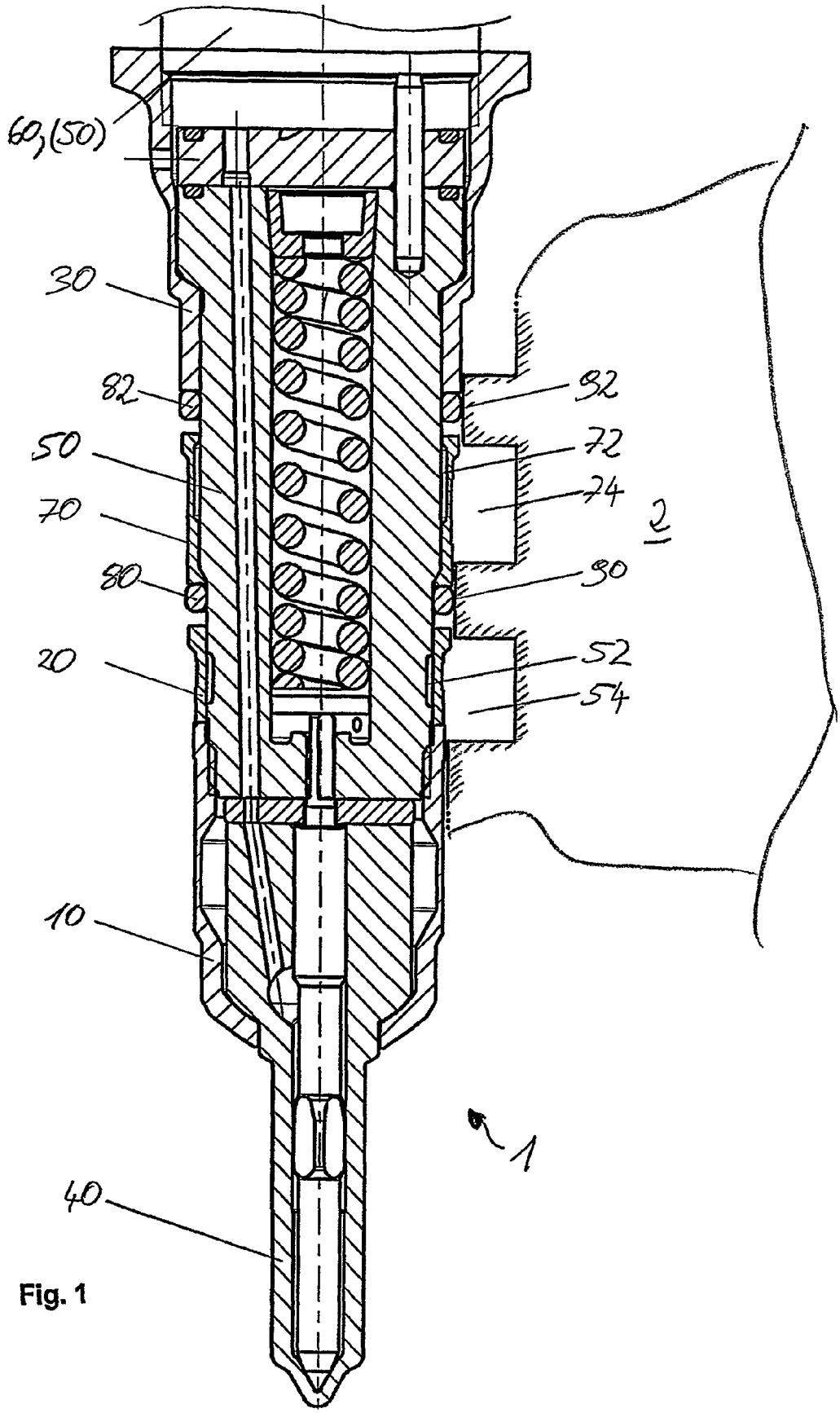
FIG. 1 is a section on the nozzle side through a fuel injector according to an embodiment having a fuel-filter sleeve arranged between two clamping nuts.

According to various embodiments, a fuel injector whose clamping sleeve(s) only perform(s) functions which, alongside of being an external design for providing a seal between the fuel injector and a cylinder head, serve to mutually clamp main components of the fuel injector. Secondary functions such as filtering or, as the case may be, providing a fuel-inlet or fuel-return conduit connector are provided separately from the clamping sleeves. What is particularly realized therein is a fuel injector having a nozzle clamping nut that does not contain a filter device or apparatus, and a fuel filter that is provided on the fuel injector on an injector body spatially independently of the nozzle clamping nut. Furthermore, according to an embodiment, a clamping sleeve, in particular a lower clamping nut, contains no device or apparatus for a fuel-return conduit connector. The fuel-return conduit connector is therein embodied as being spatially separate from the lower clamping nut.

Separating the primary function (mutually clamping the main components of the fuel injector) and a secondary function (filtering the inflowing fuel or, as the case may be, providing a connector device for a fuel-inlet or fuel-return conduit) of clamping sleeves enables the relevant clamping sleeve to be designed, embodied and worked totally in keeping with its primary function. That applies likewise to the component performing the detached secondary function. The materials employed for the respective work piece and hence also the methods used for working it can be optimized thereby.

Specifically, the nozzle clamping nut's sole function—apart from sealing the fuel injector from a combustion chamber of an internal combustion engine—is therein to clamp a nozzle body to an injector body, as a result of which the nozzle clamping nut can be designed exclusively in terms of said function and in terms of the conditions prevailing when the fuel injector is operating. As regards the function of providing a seal between the fuel injector and combustion chamber, the nozzle clamping nut remains unchanged in its internal structure; for that it is necessary only for a sealing surface to be provided externally on the nozzle clamping nut. A filter sleeve providing the filter function can likewise be designed totally in terms of its filtering function and its subsequent conditions during operation.

The same applies to the lower clamping nut's dimensioning, which can be geared totally to the mechanical and thermal loading of said nut, and also to a fuel-return conduit connector, which can be accommodated to the requisite functions and prevailing conditions.

According to an embodiment, two separately arranged clamping sleeves, a nozzle clamping nut and a lower clamping nut, are provided on the fuel injector, with the nozzle clamping nut rigidly securing the nozzle body against a spring retainer or, as the case may be, spring body of the injector, and with the lower clamping nut rigidly securing the spring retainer against a lower body of the injector. Provided therein on the spring retainer between the two clamping sleeves is a fuel-filter sleeve for filtering the inflowing fuel and, likewise on the spring retainer, a fuel-return sleeve serving as a fluid conduit for returning fuel. The fuel-filter sleeve is therein provided preferably directly adjacent to the nozzle clamping nut, whereas the fuel-return sleeve is provided adjacent to the lower body.

The clamping sleeves are both very strong since no further apparatuses or, as the case may be, devices performing other functions have to be provided thereon or, as the case may be, therein, said functions being performed by the fuel-filter sleeve or, as the case may be, fuel-return sleeve. The nozzle clamping nut can therein be produced from a material different from that used for the fuel-filter sleeve or, as the case may be, the lower clamping sleeve can therein be produced from a material different from that used for the fuel-return sleeve.

That has the major advantage that the components, and hence the results that can be achieved therewith, can be handled separately.

In the case of the fuel-filter sleeve, for example, it will no longer be necessary to consider the extent to which a clamping sleeve having filter bores will be weakened thereby, so that with the fuel-filter sleeve according to an embodiment a larger opening cross-section compared to a nozzle clamping nut having filter bores can be provided for the fuel flowing through. An annular gap between the fuel-filter sleeve and spring retainer is therein matched to the dimensions of the filter bores, with said gap either being within a range similar to the diameter of the fuel bores so that the annular gap can likewise be used as a fuel-inlet conduit having a filter function, or with the annular gap being smaller than the filter bores so that a filter function having a supply function will likewise still be insured but not to the same extent as in the previous instance. The annular gap between the filter sleeve and spring retainer is, though, preferably within the range of an average diameter of the filter bores.

According to an embodiment, a sealing device, in particular an O-ring, is in each case provided between the fuel-filter sleeve and fuel-return sleeve and between the fuel-return sleeve and lower clamping nut. When the fuel injector is in its mounted condition, said O-rings are applied against corresponding circular sealing surfaces in the cylinder head so that embodied between the fuel injector and cylinder head are in each case two separate circular fuel-ducting areas which on the one hand can be designed as being of generous proportions and, on the other, are spatially mutually separated. That makes it possible to feed fuel sufficiently to or, as the case may be, to duct fuel sufficiently from the fuel injector at any instant during its operation without its having to work against too great a fluidic resistance in the inlet conduit or, as the case may be, return conduit.

Thanks to the separate embodiment of the fuel-filter sleeve and lower clamping nut, the O-rings are moreover prevented from being crushed and jammed when the fuel injector is seated obliquely in the cylinder head. The frictional connection at the sealing washer sealing the fuel-inlet conduit is furthermore decoupled from the front seating surfaces of the fuel injector on the cylinder head, which will increase the sealing device's durability and render it immune to damage when being installed.

According to an embodiment, the filter bores are produced in the fuel-filter sleeve in a spiral having 5.21 revolutions in the circumferential direction, with 144 filter bores being provided for each turn to give 750±1 filter bores in total that will all or virtually all perform a filter function in the case of the embodiment of the fuel-inlet conduit as an annular chamber. A preferred diameter of a respective filter bore is 75 μm, with a −25 μm to +15 μm tolerance being provided. A preferred material for the fuel-filter sleeve according to an embodiment is 42CrMo4.

According to an embodiment, a circumferential wall of the fuel-filter sleeve is L-shaped in profile, which, given a provided annular fuel-ducting area according to an embodiment, will result in a good flow characteristic for the fuel during its approach and run-back (shock waves in the fuel), as a result of which erosion damage in the cylinder shaft can be avoided.

The section, shown in FIG. 1, on the combustion chamber side through a fuel injector 1 is a section through a pump-nozzle injector, with the following explanations not being intended to relate exclusively to a pump-nozzle injector but expressly to include other fuel injectors such as, for example, fuel injectors for common-rail systems.

The fuel injector 1, shown in FIG. 1, that extends in a longitudinal direction L has been mounted in a housing 2 of an internal combustion engine, in particular in a cylinder head 2, with a section of the cylinder head 2 being enlarged on a longitudinal side of the fuel injector 1 and shown only schematically. The fuel injector 1 according to an embodiment therein has a nozzle body 40 and an injector body 50 formed in this embodiment from a spring body 50 or, as the case may be, spring retainer 50 and a lower body 60. Other embodiments of the fuel injector 1 are of course possible, with its being possible for the injector body 50 also to be embodied as being, for example, substantially of one piece.

In the exemplary embodiment shown, the nozzle body 40 is secured clamped against the spring body 50 by means of a nozzle clamping nut 10 in a manner allowing them to be mutually released axially. The spring body 50 is furthermore secured clamped against the lower body 60 by means of a lower clamping nut 30 in a manner allowing them to be mutually released axially.

The lower body 60 therein has a pump piston, guided axially in a pump housing, that is moved axially back and forth by a plunger and a cam of a cam shaft against a restoring force of a spring (not shown in the figures). The lower body 60 furthermore has a control valve which, by means of a piston valve, controls a flow of fuel through an inlet channel, embodied inside the fuel injector 1, in a manner coordinated with a position of the pump piston (likewise not shown). The control valve is therein preferably actuated by means of a piezoelectric drive.

The fuel-inlet channel, not shown in the figures, of the fuel injector 1 is supplied with fuel by a fuel-inlet conduit 52 embodied preferably as an annular chamber. The fuel-inlet conduit 52, and also a fuel-return conduit explained further below, is embodied as an annular chamber completely encircling the fuel injector 1. Other embodiments of the fuel-inlet conduit 52 or, as the case may be, fuel-return conduit are of course also possible. For example it is conceivable for the relevant annular chamber to be provided not as completely but as only partially encircling. It is furthermore possible for the fuel-inlet conduit 52 or, as the case may be, fuel-return conduit to be provided simply as a bore pointing radially inward into the fuel injector 1.

In the embodiment of the fuel injector 1 a fuel filter 20 embodied as a sleeve is provided around the fuel-inlet conduit 52. The fuel filter 20 is therein provided independently of the nozzle clamping nut 10. In the embodiment, in the longitudinal direction L of the fuel injector 1 the fuel filter 20 directly abuts the nozzle clamping nut 10 on the spring body 50. The nozzle clamping nut 10 and fuel filter 20 can therein be provided mutually independently on the fuel injector 1 and are installed sequentially. The fuel filter 20 is therein first pushed onto the spring body 50, which is then screwed to the nozzle body 40 by means of the nozzle clamping nut 10.

The fuel-inlet conduit 52 embodied as an annular chamber is therein preferably provided as an annular recess in the spring body 50. It is, though, also possible for the fuel-inlet conduit 52 to be provided as an annular recess in the fuel filter 20 and to be formed from annular recesses located both externally in the spring body 50 and internally in the fuel filter 20. The same applies to the fuel-return conduit, though in a preferred embodiment with the annular chamber here being provided not in the spring body 50 but internally in the relevant fuel-return conduit connector.

Adjoining the fuel filter 20 axially toward the lower body 60 is, apart from a sealing washer 80, a fuel-return conduit connector 70. Said fuel-return conduit connector 70 is formed by a sleeve serving as a connector for a return flow of the fuel through the cylinder head. For that purpose the cylinder head has a return bore (not shown in the figures) through which the fuel can flow away. An inlet bore is provided in a similar manner in the cylinder head 2 at the height of the fuel-inlet conduit 52 of the fuel filter 20.

Adjoining again axially toward the lower body 60 the fuel-return conduit connector 70 is the lower clamping nut 30 that securely clamps the spring body 50 to the lower body 60.

In this exemplary embodiment the nozzle clamping nut 10, the fuel filter 20, the fuel-return conduit connector 70, and the lower clamping nut 30 are designed as four, mutually independent, substantially sleeve-shaped, radially symmetric components. It is, of course, possible to functionally link said four parts' individual functions, although attention will have to be paid to the different requirements during working and within the subsequent field of application or, as the case may be, subsequent application-related function. For example it is possible to embody the fuel filter 20 as forming a single piece in combination with the fuel-return conduit connector 70. It is further possible in another embodiment for the fuel-return conduit connector 70 to be provided on the lower clamping nut 30. It is not, though, advisable to provide all four constituents in the form of a single component because the structure of a component of said kind would be excessively weakened by filter bores in the fuel filter 20. Allowance must be made for the suitable seals or, as the case may be, sealing surfaces in the cylinder head 2 when components are joined together.

In the preferred exemplary embodiment shown in FIG. 1 there is a sealing washer 80 between the fuel filter 20 and fuel-return conduit connector 70 and another sealing washer 82 between the fuel-return conduit connector 70 and lower clamping nut 30, with the sealing rings 80, 82 being embodied preferably as O-rings. The sealing rings 80, 82 interact with a respective sealing surface 90, 92 on the cylinder head 2 when the fuel injector 1 is in its mounted condition with the cylinder head 2. Two fuel-ducting areas 54, 74 will then be embodied one above the other between the cylinder head 2 and fuel injector 1. The fuel-ducting area 54 therein supplies the fuel-inlet conduit 52 (through the fuel filter 20) of the fuel injector 1 with fuel, and the fuel-ducting area 74 receives fuel from the fuel-return conduit 72 (through the fuel-return conduit connector 70) of the fuel injector 1. The two fuel-ducting areas 54, 74 are mutually sealed against fluid by means of the sealing washer 80 so that no direct fluidic communication takes place between the two fuel-ducting areas 54, 74. The fuel-ducting areas 54, 74 are preferably both designed as being annular so that, together with the annular fuel-inlet conduit 52 or, as the case may be, annular fuel-return conduit 72, circulating fluidic communication will be possible in the circumferential direction around the fuel injector 1.

Figure 2:
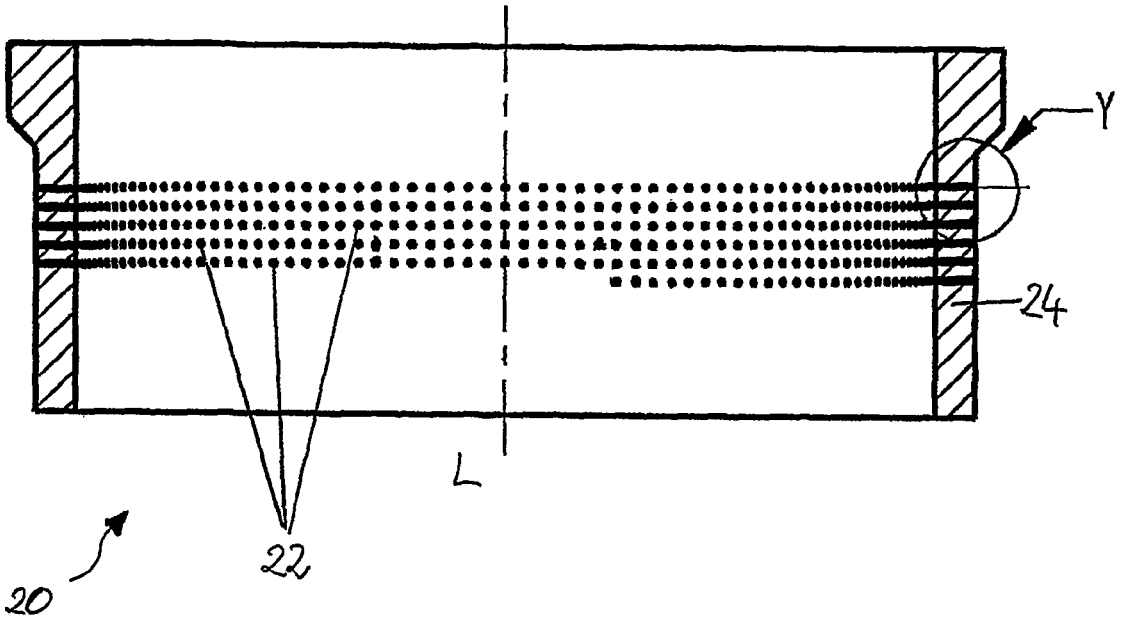
FIG. 2 is an enlarged representation of the fuel-filter sleeve shown in FIG. 1 and a sectional enlargement Y of the fuel-filter sleeve.
Figure 2:
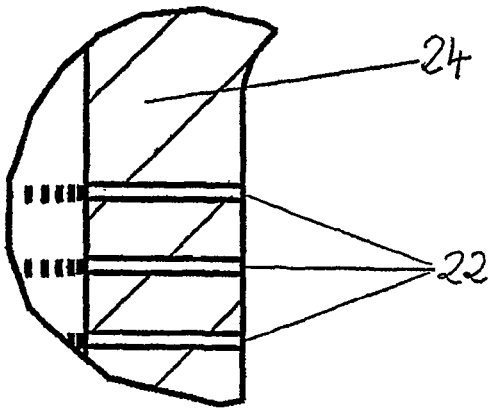

FIG. 2 shows the fuel filter 20 according to an embodiment for the fuel injector 1, with the fuel filter 20 being embodied as a filter sleeve or, as the case may be, filter pipe.

The fuel filter 20 has a multiplicity of filter bores 22 that encircle the circumferential wall 24 in the circumferential direction and are preferably regularly disposed spaced equally apart. In an embodiment the filter bores 22 are therein embodied in the circumferential direction of the circumferential wall 24 as a spiral arranged substantially perpendicular to the longitudinal axis L of the fuel filter 20. What is produced thereby is a fuel filter 20 that is perforated in a circumferential ring. Said circumferential ring is preferably located in a longitudinal center of the fuel filter 20. Other locations are, of course, also possible, as is a complete perforation of the circumferential wall along its entire longitudinal extent. Other embodiments of the arrangement of the filter bores 22 are, of course, also possible. For example the filter bores 22 can be provided in the circumferential wall 24 not as a spiral but as circular rings, which will be more or less advantageous depending on the specific method chosen for providing the filter bores 22. Instead of the filter bores 22 provided in the fuel filter 20 it is furthermore possible to provide suitably narrow filter slits that can be longitudinal and/or transverse and/or diagonal.

A circumferential wall 24 of the fuel filter 20 is shaped in terms of its cross-sectional profile like an L having a short foot, which shape can be seen enlarged in Detail Y in FIG. 2.

Further to be seen in Detail Y in FIG. 2 are three filter bores 22 and a transitional area in the circumferential wall 24 from the long spine of the L to its short foot. The filter bores 22 are in this exemplary embodiment cylindrical bores having a mean diameter of 75 μm. In another embodiment said filter bores 22 can be conical, with preferably the cone's larger diameter being provided externally on the fuel filter 20.

The transition from the long spine to the short foot of the L takes place preferably at an angle of 45°, with the radius, shown in Detail Y, of the transition from the long spine to the short foot of the L preferably being 0.4 mm.

The filter bores 22 of the fuel filter 20 are produced preferably by means of a pulsed electron or laser beam, with one filter bore 22 being produced with each pulse. The fuel filter 20 is therein turned around its own longitudinal axis L. The diameter, shape and embodiment of the filter bores 22 can be influenced as a function of the duration and intensity of the energy pulses.

During production of the filter bores 22 it must be insured that the opposite internal side of the circumferential wall 24 is not damaged when the circumferential wall 24 of the fuel filter 20 has been pierced through by the energy beam and that any filter bores 22 already provided on said side are not altered. It may furthermore be necessary during production of the filter bores 22 to pay attention to burr formation on the inside of the fuel filter 20 and to take suitable countermeasures. That can be done by, for example, using an underlay material that can additionally help with the problem of piercing by the energy beam and will prevent corresponding damage to the opposite inner wall. Burr formation can furthermore occur during production of the filter bores of the fuel filter 20 due to the adhesion of burrs arising during the working process to the outer surface of the fuel filter 20, which occurrence can be countered by application of a coating to the fuel filter 20.

The invention claimed is:

1. A fuel injector, comprising:

an injector body being clamped by means of a nozzle clamping nut to a nozzle body, and a fuel filter provided on a fuel-inlet conduit of the injector body, wherein the fuel filter is with reference to a longitudinal direction of the fuel injector arranged offset relative to the nozzle clamping nut and is embodied independently of the nozzle clamping nut on the fuel injector;

wherein the nozzle clamping nut externally clamps the nozzle body to the injector body and the fuel filter on the injector body, adjoining the nozzle clamping nut in the longitudinal direction of the fuel injector, is provided externally.

2. The fuel injector according to claim 1, wherein a lower clamping nut externally clamps a lower body to the injector body and a fuel-return conduit connector, serving as a fluid conduit for a fuel-return conduit, on the injector body is applied externally adjacent to the lower clamping nut in the longitudinal direction of the fuel injector.

3. The fuel injector according to claim 2, wherein, apart from sealing devices, on the injector body, the nozzle clamping nut adjoins the fuel filter , which adjoins the fuel-return conduit connector which adjoins the lower clamping nut sequentially in the longitudinal direction.

4. The fuel injector according to claim 2, wherein provided on the injector body between the fuel filter and fuel-return conduit connector is a sealing washer and, directly adjacent to the lower clamping nut, an additional sealing washer that is arranged preferably between the lower clamping nut and fuel-return conduit connector, with the sealing washer and the additional sealing washer sealing the fuel injector section by section from a cylinder head.

5. The fuel injector according to claim 2, wherein the fuel-return conduit is embodied as an annular chamber substantially completely encircling the injector body, which chamber is adjoined radially outward by the fuel-return conduit connector embodied as a single annular sleeve.

6. The fuel injector according to claim 5, wherein the fuel-return conduit embodied as an annular chamber is formed by means of an annular recess in the injector body or, preferably, by means of an annular recess in the fuel-return conduit connector.

7. The fuel injector according to claim 1, wherein the fuel-inlet conduit is embodied as an annular chamber substantially completely encircling the injector body, which chamber is adjoined radially outward by the fuel filter embodied as a single annular sleeve.

8. The fuel injector according to claim 7, wherein the fuel-inlet conduit embodied as an annular chamber is formed preferably by means of an annular recess in the injector body or by means of an annular recess in the fuel filter.

9. The fuel injector according to claim 7, wherein a gap width between the annular sleeve and a spring retainer is 20 to 90 μm.

10. The fuel injector according to claim 1, wherein provided for filtering in a circumferential wall of the fuel filter are a multiplicity of substantially radially arranged filter bores that are arranged in the circumferential direction of the circumferential wall preferably in an encircling spiral and which have three to eight revolutions in the circumferential direction of the fuel filter.

11. The fuel injector according to claim 10, wherein the fuel filter has 80 to 200 filter bores in each turn of the spiral.

12. The fuel injector according to claim 11, wherein the filter bores are produced by means of an electron or laser beam, with the relevant energy beam being operated in a pulsed manner and one filter bore being produced with each pulse.

13. The fuel injector according to claim 10, wherein a cross-sectional profile of the circumferential wall of the sleeve-shaped fuel filter is substantially L-shaped, with the free end of the longer spine of the L being preferably seated on the nozzle clamping nut.

14. A cylinder head or diesel engine having a fuel injector comprising:

an injector body being clamped by means of a nozzle clamping nut to a nozzle body, and a fuel filter provided on a fuel-inlet conduit of the injector body, wherein the fuel filter is with reference to a longitudinal direction of the fuel injector arranged offset relative to the nozzle clamping nut and is embodied independently of the nozzle clamping nut on the fuel injector;

wherein the nozzle clamping nut externally clamps the nozzle body to the injector body and the fuel filter on the injector body, adjoining the nozzle clamping nut in the longitudinal direction of the fuel injector, is provided externally.

15. The cylinder head or diesel engine according to claim 14, including two mutually separate, annular fuel-ducting areas.

16. A pump-nozzle injector for a diesel engine, comprising:

an injector body, a nozzle clamping nut clamping the injector body to a nozzle body, and a fuel filter arranged on a fuel-inlet conduit of the injector body, wherein the fuel filter is arranged offset relative to the nozzle clamping nut with respect to a longitudinal direction of the pump-nozzle injector and is embodied independently of the nozzle clamping nut on the pump-nozzle injector;

wherein the nozzle clamping nut externally clamps the nozzle body to the injector body and the fuel filter on the injector body, adjoining the nozzle clamping nut in the longitudinal direction of the pump-nozzle injector, is provided externally.

17. The pump-nozzle injector according to claim 16, wherein a lower clamping nut externally clamps a lower body to the injector body and a fuel-return conduit connector, serving as a fluid conduit for a fuel-return conduit, on the injector body is applied externally adjacent to the lower clamping nut in the longitudinal direction of the fuel injector.

18. The pump-nozzle injector according to claim 17, wherein—apart from sealing devices—the fuel filter, and adjoining that the fuel-return conduit connector, and in turn adjoining that the lower clamping nut are arranged in a row next to each other in the longitudinal direction on the injector body on the nozzle clamping nut.

* * * * *